166-66 SR

5/12/87 XR 4,664,189

United States Patent [19]

Wittrisch

[11] Patent Number: 4,664,189

[45] Date of Patent: May 12, 1987

[54] METHOD AND DEVICE FOR CARRYING OUT MEASUREMENTS AND OPERATIONS IN A WELL

[75] Inventor: Christian Wittrisch, Rueil Malmaison, France

[73] Assignee: Institut Francais Du Petrole, Rueil Malmaison, France

[21] Appl. No.: 623,013

[22] Filed: Jun. 21, 1984

[30] Foreign Application Priority Data

Jun. 22, 1983 [FR] France ..... 83 10432

[51] Int. Cl.[4] ..... E21B 47/00

[52] U.S. Cl. ..... 166/250; 166/66; 166/383; 166/385

[58] Field of Search ..... 166/250, 242, 65 R, 166/77, 66, 381, 383, 385

[56] References Cited

U.S. PATENT DOCUMENTS

| | | | |
|---|---|---|---|
| 4,064,939 | 12/1977 | Marquis | 166/77 |
| 4,082,144 | 4/1978 | Marquis | 166/242 |
| 4,168,747 | 9/1979 | Youmans | 166/250 |
| 4,349,072 | 12/1982 | Escaron et al. | 166/250 |
| 4,484,628 | 11/1984 | Lanmon, II | 166/65 R |
| 4,485,870 | 12/1984 | Walulik | 166/250 |
| 4,488,597 | 12/1984 | Hoppe et al. | 166/250 |

*Primary Examiner*—Stephen J. Novosad
*Assistant Examiner*—Bruce M. Kisliuk
*Attorney, Agent, or Firm*—Antonelli, Terry & Wands

[57] ABSTRACT

A method and device are provided for carrying out measurements and/or operations in a well. In this method at least one tube is used which includes at least two parts one of which is an upper tubular part and another of which is a lower tubular part, an extension having an upper end and a lower end and an instrument for carrying out measurements and/or operations fixed to the lower end of said extension. The method involves the steps of:

(a) fitting said extension equipped with said instrument to the lower part of said tube, (b) fitting the upper part of the tube above the lower part of the tube thereby providing greater penetration into the well of the assembly formed by the lower tube, the extension and the instrument and (c) effecting movement of the extension and of the instrument with respect to the tube to a position of said instrument where the measurement and/or operations may be carried out.

11 Claims, 15 Drawing Figures

28
29
27
26
23
22
2a
15
14
12
1
2b
3
21
13
12
1
2b
3
21
2a

METHOD AND DEVICE FOR CARRYING OUT MEASUREMENTS AND OPERATIONS IN A WELL

BACKGROUND OF THE INVENTION

1. Field of the Invention

The present invention relates to a method and device for carrying out measurements and/or operations in a well at the level of the surrounding formations.

The invention is more especially applicable when it is a question of carrying out measurements and/or operations at the level of geological formations. In this case, the measurements made may comprise recording of the pressure and temperature at the bottom, the measurement (focused or not) of the electric resistivity, as well as acoustic, nuclear measurements, etc.

These measurements and operation techniques are well known by specialists and will not be described in greater detail here.

The measurements may be completed by displaying the walls of the well by means of television cameras, for example.

2. Discussion of the Prior Art

U.S. Pat. No. 4,349,072 discloses a device for carrying out measurements and/or operations in a well, this device comprising a tube open at its lower end and of a diameter less than that of the well, a measuring or operating (probe) instrument, movable by remote control from the surface between a first position where said instrument is housed in the lower part of the tube forming a protection casing and a second position in which said instrument leaves said tube at least partially at the lower end thereof so as to carry out the measurement or the operation, and an electric transmission cable equipped with a first electrical connection member adapted to be moved in the tube for joining up with a second electrical connection member coupled to said instrument.

According to this patent, the tube equipped with a probe is lowered into the well, then an extension is sent from the surface towards the probe to which it is secured. The assembly thus formed (probe plus extension) is then pumped so as to cause the probe to travel along the zone to be explored.

Such a tube requires then the lowering from the surface of a more or less long extension depending on the extent of the zone of the well to be explored. Furthermore, the further away the zone to be explored, the greater the length over which the extension must be conveyed. Thus, the tube is immobilized in its lower position for long periods of time. This represents high risks of the tube jamming in the well. These risks are increased if the well runs out of the vertical.

By the expression "out of the vertical wells" is meant here, as well as in the rest of the description, not only wells with a slight deflection but also greatly deflected or substantially horizontal wells.

It should be noted that the present invention may also be used in the vertical portions of the wells.

The prior art may be further illustrated by U.S. Pat. No. 4,064,939, 4,082,144 and 4,388,969 as well as by the European patent application No. 0,077,275.

This document describes a method which requires the extension to be sent by pumping through a tube from the surface as far as the position where measurements are to be carried out.

The drawbacks of the devices of the prior art are considerably reduced if not eliminated by using the method and device of the present invention for carrying out measurements and/or operations in a well.

SUMMARY OF THE INVENTION

The method of this invention uses at least one tube comprising at least two parts, a so called upper one and a lower one an extension which may be tubular having two ends, one so called upper end and a lower end, and an instrument for measuring and/or carrying out operations fixed at the lower end of the extension.

Each of the two parts of the tube as well as the extension may comprise several elements. The method of the invention comprises successively the following steps:

(a) fitting of said extension equipped with the instrument on the lower part of the tube, (b) fitting of the upper part of the tube over the lower part of the tube, this step being accompanied by a greater penetration into the well of the assembly formed by the lower tube, the extension and the instrument, (c) movement of the extension with respect to the tube to a position of said instrument allowing the measurements and/or operations.

Another variant of the method of the invention is applicable when the instrument is connected electrically to the surface, and when it comprises a first connector comprising first and second electrical connector portions, these two electrical connector portions being possibly of the multi contact type able to be connected together in a liquid medium, said first connector portion in normal use being fixed with respect to the extension.

In this variant, the following additional step is used:

the second connector portion is introduced into the tube as far as the first connector portion and said portions are connected together, said second connector portion being fixed mechanically and electrically at the lower end of the first electric transmission cable, this cable being connected at its upper end to the surface installations.

At the end of this additional step which comes after the above defined step C, the second connector portion is interlocked with the extension.

The preceding variant may be completed by other steps. Thus, when the method is applied to the case where the instrument is connected electrically to the first connector portion by an intermediate electrical connection comprising a second connector which comprises third and fourth electrical connector portions, these two portions being of the multi contact type and if required able to be plugged together in a liquid medium, when a third connector portion is connected electrically to the instrument and when it is fixed with respect to the extension preferably in the vicinity of its lower end, the following additional step may be used:

the fourth connector portion is introduced into the extension and is connected with the third portion, said third connector portion being fixed mechanically and electricaly to the lower end of a second electric transmission cable, this cable being connected at its upper end to said first connector portion of the first connector.

At the end of this additional step which comes after the above defined steps a and b, said fourth connector portion is possibly interlocked with the extension in the vicinity of its lower end.

It is possible, when using the method of the invention, that one at least of the second and fourth electric connector portions is moved by pumping, especially when the method is used in deflected wells.

According to the invention, some at least of the movements of the extension may be caused by pumping a fluid such as gas, liquid, liquid plus sludge, diphasic fluid etc.

It will be also be possible to cause some of the movements of the extension, particularly its insertion in the tube, by a traction exerted on the first electric cable.

At the end of a movement of the extension corresponding to the action of said instrument on a first zone of the well, it will be possible, in accordance with the invention, to return the extension inside the tube, in the initial position occupied by this extension, before the above defined step c and to modify the length of the upper tube so as to allow said instrument to move to the neighborhood of the new zone of operation.

In this case, it may be advantageous for practical reasons to withdraw the second connector portion as well as the first cable from the upper tube before modifying the length of this latter.

The first cable may possibly penetrate into the upper tube through a coupling with lateral window.

It is possible, according to the method of the invention, to leave the extension suspended from the lower tube in its position outside the tube during penetration of the tube into the well or during the assembly of the lower tube, more especially when this latter is formed from several elements. With the extension thus left suspended, the outer diameter of the probe may be greater than the inner diameter of the lower tube. It is possible to fit the lower tube and the extension at the same time provided that these two members are formed from several elements coaxial in pairs and substantially of the same length.

The present invention also proposes a device for carrying out measurements and/or operations in a well. This device comprises at least one tube and an extension which may be possibly tubular having two ends, one so called lower end and an upper end, said tube being adapted to support said extension and comprising at least two parts, one so called upper part and a lower part, each of these two parts as well as the extension possibly comprising several elements.

In this device, said instrument is firmly secured to the lower end of the extension and the device comprises means for anchoring said extension to the lower part of the tube, these means being unlockable from the surface and means for moving the extension with respect to the tube.

The anchorage means may be for example mechanical, electrohydraulic or of any other known type. A first embodiment of the device is applicable to the case where the instrument is connected electrically to a first electric connector which comprises first and second electrical connector portions, said first connector portion being fixed with respect to the extension.

This embodiment comprises a first electric transmission cable whose lower end is fixed mechanically and electrically to said second connector portion and whose upper end is connected to the surface installations and said second connector portion comprises in its vicinity engagement means which cooperate with complementary means disposed in the vicinity of the upper end of the extension.

This first connector may be located at any position on the extension. However, it will be advantageous to place it either in the vicinity of the upper end of the probe, for that avoids having to move the second connector portion inside the extension which is of a diameter different from that of the lower tube, or in the vicinity of the instrument.

This latter solution avoids using along intermediate electrical connection between the instrument and the first connector portion of the connector. Moreover, in this case, the first connector portion may be placed directly on the instrument.

Finally, it is also possible to use a sliding piston which will facilitate pumping of the second connector portion in the tube, this piston may cooperate if required with a recess formed in the tube substantially at the position where its action is to cease.

A second embodiment, completing the first one, is applicable when the instrument and the first connector portion are connected electrically together by using a second connector comprising a third connector portion and a fourth connector portion, said third connector portion being integral with the extension in the vicinity of its lower end.

This second embodiment comprises a second electric transmission cable whose lower end is fixed mechanically and electrically to said fourth connector portion and whose upper end is connected to the first connector portion.

The second and fourth connector portions may be provided with means ensuring their movement by pumping fluid from the surface.

The device of the invention may comprise means for moving the extension by pumping fluid from the surface.

Thus the extension may be equipped with a piston or may pass through a constriction in the upper tube, this constriction creating a sufficient pressure difference for moving the extension.

The extension may be provided with orifices for causing a fluid to flow from the zone situated upstream of the piston or constriction towards the zone situated downstream.

The fluid outlet orifice may be situated in the vicinity of the probe, or be positioned so that it only allows the fluid to flow when the extension has reached predetermined positions, this orifice being situated for example in the vicinity of the position occupied by the probe when this latter is extended to the maximum.

Of course, the passage sections of these orifices or more generally the pressure drops in these fluid flow channels will be determined so as to allow the extension to project over the desired length under the action of the pressure forces.

The extension will have to have sufficient rigidity for moving the instrument in the well.

In another embodiment, the extension may be formed from several tubular elements each of which comprises electric connectors, these elements ensuring the electrical and mechanical connection between the instrument and the first connector.

The movements of the extension for causing it to return into the tube are obtained by exerting a traction force on the first electric cable which, in this case, will have sufficient mechanical strength for withstanding such forces.

The second or fourth electrical connector portion may be equipped with unlockable engagement members. These members may be mechanical, electrohydraulic or of any other known type. In the case where these members comprise shearable washers, the electric cables will have appropriate mechanical characteristics for withstanding the traction forces causing shearing of the washers.

The first electric cable may penetrate into the tube through a coupling with lateral window (often called "side entry sub").

Of course, if the dimensions of the anchorage means allow it, the diameter of the lower part of the tube may be the same as that of the upper part of the same tube.

BRIEF DESCRIPTION OF THE DRAWINGS

The invention will be better understood from reading the following description of one embodiment, illustrated by the accompanying drawings in which.

DESCRIPTION OF THE PREFERRED EMBODIMENTS

Figure 1:
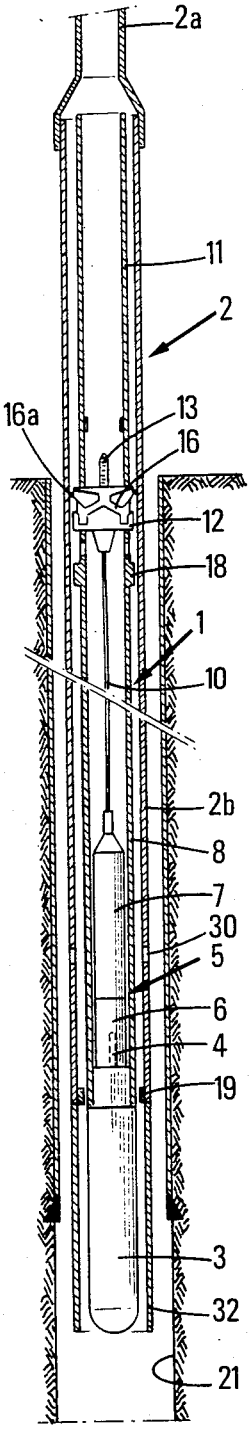
FIG. 1 shows a device in accordance with the invention during positioning thereof in the well.

FIG. 1 shows schematically a non limiting embodiment of the device according to the invention. In this first Figure, the device is shown at the end of the first step, i.e. at the end of fitting the extension part 1 to the lower part 2*b* of tube 2.

This lower part 2*b* may be formed of several elements, for example, such as those used for forming tubing.

In the example considered, extension 1 comprises a tube 8 which may be formed of several elements, for example, such as those used for oil production pipes (often called "tubing").

An operating and/or measuring means 3, such as a well-logging probe is placed at the first end or lower end of the tubular extension 1.

At the second end of the extension is placed a first connector portion 13 of a first connector 9. This first connector 9 comprises a second connector portion 14 which is connected to the surface by a first electric cable 29.

The operating means 3 is provided with a third connector portion 4 belonging to a second electric connector 5 having if required several contacts. Reference 6 designates the fourth connector portion of this connector 5. This portion may have mounted thereover a loading or weighting bar 7. In the example illustrated by the Figures, the third connector portion is a male plug and the fourth a female socket however, this is in no way limiting.

A locking system, for example electrohydraulic or mechanical, holds the third connector portion 4 on the fourth connector portion 6 after connection.

The fourth portion 6 of the second connector 5 is coupled to the first connector portion 13 of the first connector 9 by means of a second electric cable 10.

In the Figure, the first connector portion 13 is a male plug and the second a female socket 14, but this is in no way limiting.

The first and second connectors (9 and 5) may comprise several electrical contacts.

The first connector may be fixed to a tubular support element 11 which is integral with the upper end of the tubular support element 1, this tubular extension being upon at its upper part and comprising at its lower part a support piece or base 12 equipped with an anchorage system.

The second embodiment portion 14 may have mounted thereover a loading or weighting bar 15.

An anchorage system, either mechanical (for example shearable washers adapted to connector portion 14 and cooperating with retaining members integral with tube 11), or electrohydraulic (anchorage wedges actuated by a remote controlled motor), provides a mechanical connection between bar 15 and base 12 when the electrical contact is formed between the first connector portion 13 and the second connector portion 14.

The assembly formed by the second connector portion 14 and the loading bar 15 is fixed to the lower end of the cable 29 (FIG. 2) containing electrical supply and transmission conductors connecting the instrument 3 to the surface.

Examples of electric connectors which may be used for forming the assembly of the first connector portion 13 and the second connector portion 14 are described in the patent of French invention No. 2 484717 and in the published French patent application EN No. 81/05306 "An electric connector able to be plugged-in in a liquid medium", filed on the Mar. 17, 1981.

The base 12 of the tubular support element 11 is provided with an anchorage system which may be of any known type, for example electrohydraulic or mechanical. In the example shown in the Figures, the system is entirely mechanical, and comprises a groove 16 cooperating with retaining studs 16*a*. With this system, the tubular element may be held in a first position, shown in FIG. 1, in which a first shoulder is situated below an upper stop which may be formed by a second internal shoulder 17 of the lower tube 2*b* (FIG. 2A), at a sufficient distance therefrom to allow the anchorage system to be unlocked when raising base 12 (see hereafter).

When groove 16 is released from the retaining studs 16*a*, the tubular support element 11 may take up a "low" position, either under gravity effect, or under the effect of the pressure of a fluid coming possibly from the surface. In this latter case, the extension will be provided with a piston 18. However, still within the scope of the present invention a constriction 31 may be created at the lower part of the lower tube, so as to create a pressure difference on each side of this constriction 31 when the tube is pressurized from the surface. The pressure difference is then exerted on the straight section of the extension and causes movement thereof. Thus, it is the extension itself which forms a piston (see FIG. 12).

Figures 9, 10, 11:
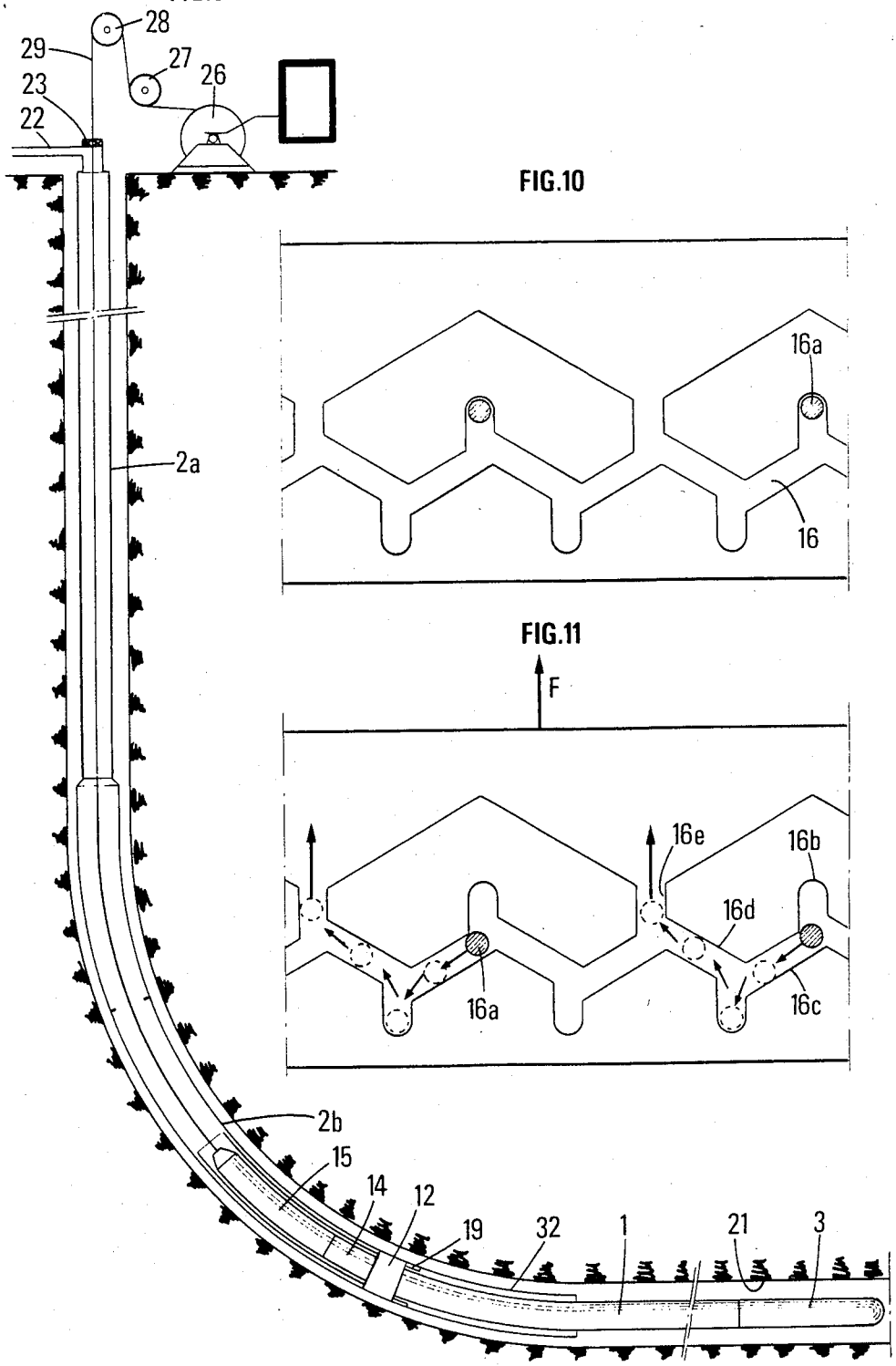
FIGS. 10 and 11 show schematically the system for anchoring the support elements respectively in the locking and unlocking positions.

As FIGS. 10 and 11 show schematically, the anchorage system of the mechanical type may comprise a W shaped groove 16 formed in the external wall of the base 12 of the tube of the support element 11, this base 12 being rotatable about a vertical axis with respect to the lower tube about the axis of this latter.

In the top position shown in FIGS. 1 and 10, the upper edge of the top of this groove is supported by a stud 16*a* integral with the inner wall of the lower tube 2*b*.

By slightly raising the assembly 11–12–13–14–15 by a traction F exerted on cable 29 from the position shown in FIG. 10, the notch 16*b* at the upper part of groove 16 is freed from studs 16*a*. The lower edge 16*c* of groove 16 then bears on this stud, causing a rotation of base 12 which places the upper edge 16*d* of groove 16 opposite the stud.

When the traction force F is released, edge 16*d* comes to bear on stud 16*a*, causing rotation of the base 12 until it is freed from stud 16*a* through the opening 16*e* (FIG. 11).

The above mentioned assembly may then be moved by gravity or by pumping to its endmost position in which piston 18 abuts against shoulder 19. Instead of the entirely mechanical anchorage system described above, base 12 could comprise an electrohydraulic anchorage system remote controlled from the surface.

Reference 2*a* designates the upper tube, which may be formed from several elements assembled together, such as those used in drilling rods.

Figure 2:
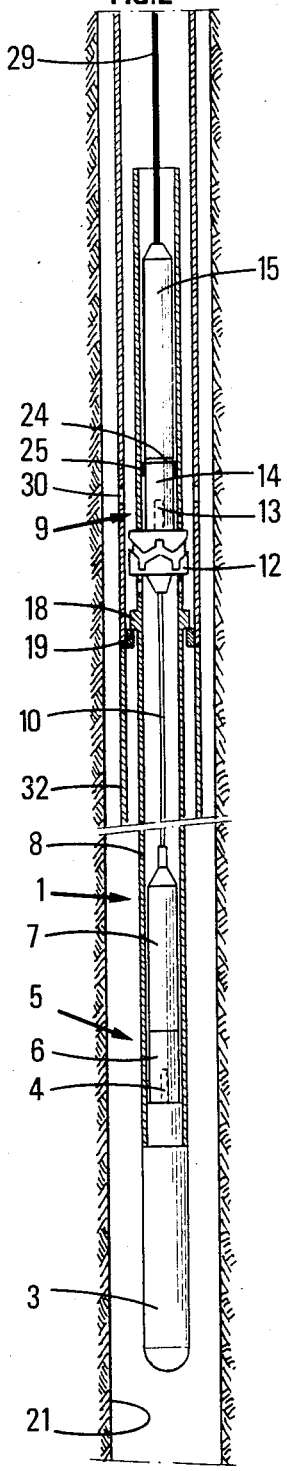
FIG. 2 shows the device in the intermediate working position.

FIG. 2 shows the assembly formed by extension 1, the mobile support 11, connectors 5 and 9 and the operating means 3 in an intermediate work position.

The method of using this device is explained below, with reference to FIGS. 3 to 9 which show the successive steps of this technique.

Figure 3:
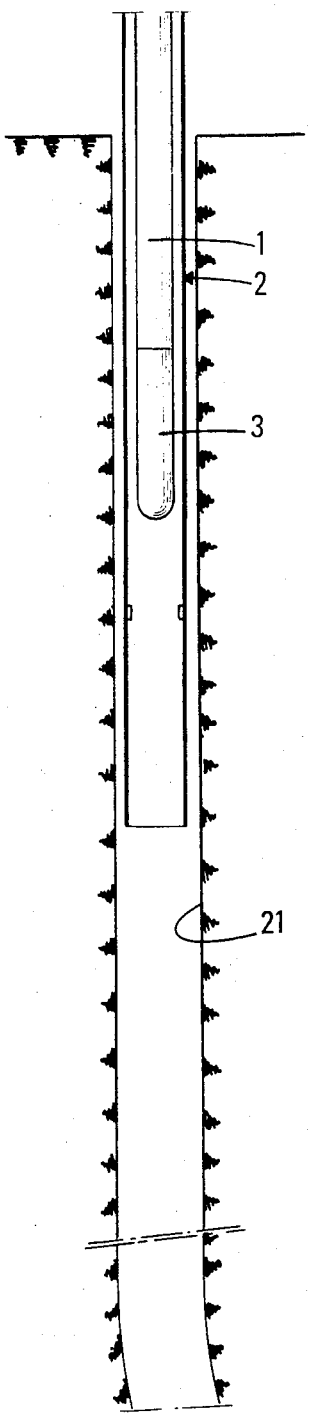
FIGS. 3 to 9 illustrate the diffent phases of using the device of the invention.

FIG. 3 shows the end of the first step in which the lower tube 2 is introduced into well 21, then the operating means 3 are fixed at the end of the first element of the tubular extension 1, this operation being carried out on the surface. The other elements forming the extension are finally fixed to each other so that the operating means 3 reaches the lower end of the lower tube 2.

It is advantageous to keep the operating means 3 as long as possible inside the layer tube so as to avoid any risk of damage to this means.

Moreover, the end of the lower tube 2 may be provided with a cap 32 for protecting the operating means 3.

At the end of this first step, the female socket 6 over which is mounted the loading bar 7 is introduced inside the tubular extension 1 and is lowered until it connects up with the male plug 4. The electrical connection thus provided being able to be controlled and ensured by techniques which are already known and which have already been discussed above.

Figure 4:
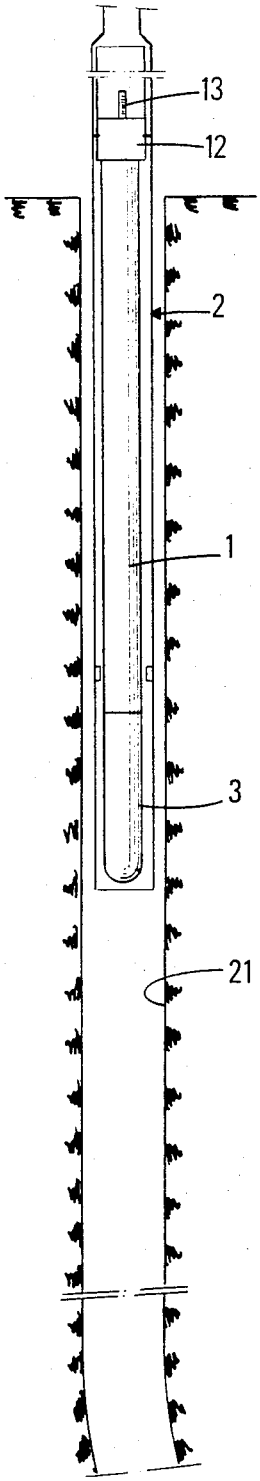

The assembly formed by piston 18, the movable support element 11 and the male plug 13 is fixed to the upper end of the extension (see FIG. 4).

Figure 3A:
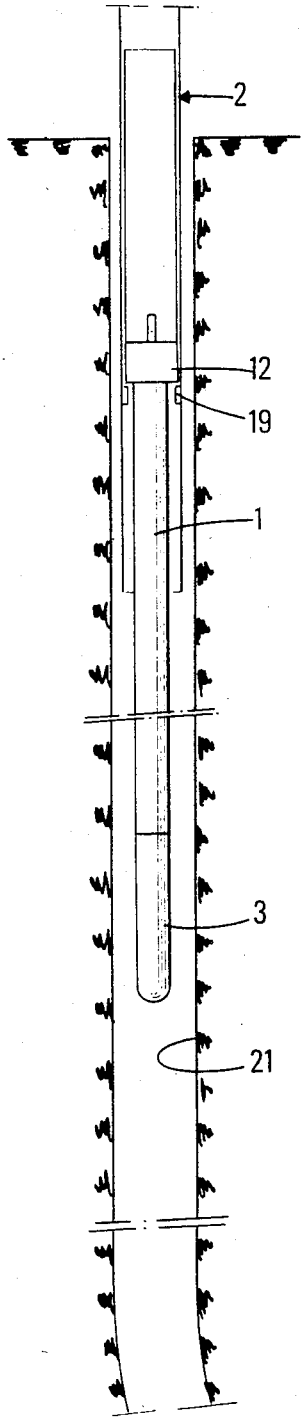

Still within the scope of the present invention, the extension may be introduced into the well by letting it hang from the lower end of the lower part 2*b* of tube 2 (see FIG. 3*a*). With this variant, a lower tube 2*b* may be used whose inner diameter is less than the outer diameter of probe 3. It is possible with this variant to introduce a cable equipped with such an engagement system so as to cause the extension 1 to return into the lower tube 2*b* and probe 3 into its protection casing 32 if such is provided. This operation is carried out preferably once the lower tube 2*b* is in position.

It will be possible according to the invention to mount the extension 1 and the lower tube 2*b* at the same time, providing that these two members are formed from elements coaxial in pairs and having substantially the same length.

During penetration of the assembly formed by the lower tube 2*b* and the extension into the well, if this latter meets an obstruction or a sufficiently deflected part to hinder its advance, it would be immobilized and would be progressively covered by the lower tube as this latter advances. Then, once the extension is completely covered, it is the lower tube 2*b* which will force the passage through the obstruction. Thus, the instrument will not have to withstand stresses likely to damage it.

Of course, in the case where an intermediate electrical connection is used by means of a second cable and a second connector, this latter will be advantageously introduced while the upper end of the extension is on the surface before penetration of the lower tube 2*b* into the well.

Figures 5, 6:
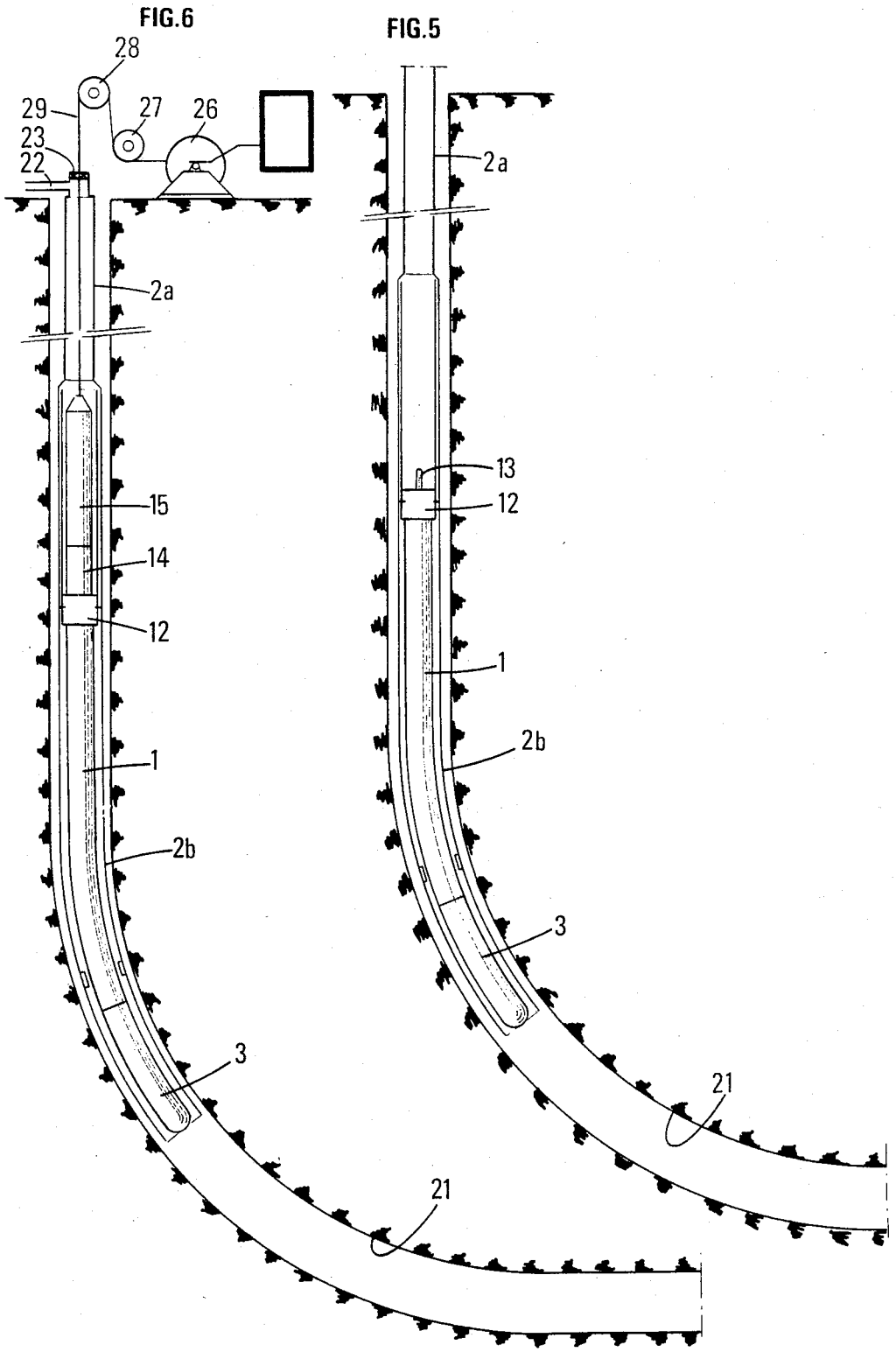

A coupling is fixed if required to the upper end of the lower tube 2*b* so as to allow positioning of the upper tube 2*a* (see FIG. 5).

The different elements forming the upper tube 2*a* are fixed to each other, thus causing a greater penetration of the lower tube 2*b* into the well 21.

This operation continues until the operating means 3 reaches substantially the position from which it is desired to carry out the operations. At this time, the female socket 14, which is fixed to the end of the cable 16 if required by inserting a loading bar 15, is introduced into the upper tube 2*a*.

The upper tube 2*a* is connected at its upper part to a pressurized hydraulic fluid supply duct 22 and is provided at the top with a safety gasket or packing 23 in which slides the cable 29 supporting the assembly formed by the loading bar 5 and the second connector portion 14 until this latter comes into engagement with the first connector portion 13 fixed to the base 12 of the tubular element 11 which supports the instrument 3, the tubular support element 11 guiding the assembly 14–15 so as to facilitate this connection (see FIG. 6).

Mechanical or electrohydraulic connection or engagement members 24 and 25 are respectively adapted to the second connector portion 14 and to the internal wall of tube 11, these members being adapted to be released from each other by a sufficient traction force exerted on cable 29 from the surface.

Figure 2A:
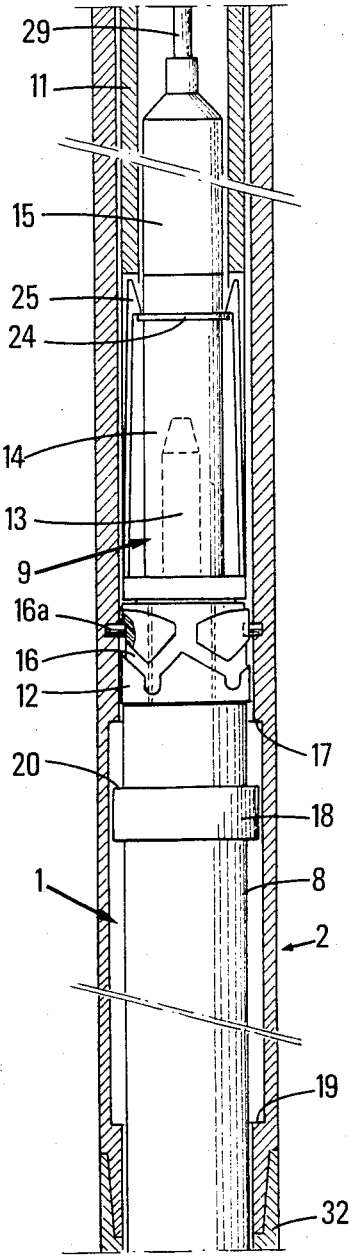
FIG. 2A is a detailed view of the device in the vicinity of the anchorage system.

In the embodiment considered which is of a mechanical type, members 24 and 25 are formed respectively by a shearable washer carried by the second connector portion 14 or the loading bar 15 and arms or blades for retaining this washer, carried by the tubular support element 11 (see FIG. 2*a*).

Cable 29 unwinds at the surface from a winch 26. Between winch 26 and gasket 23, the cable 29 passes over guide pulleys 27 and 28 (FIG. 6).

Figure 7:
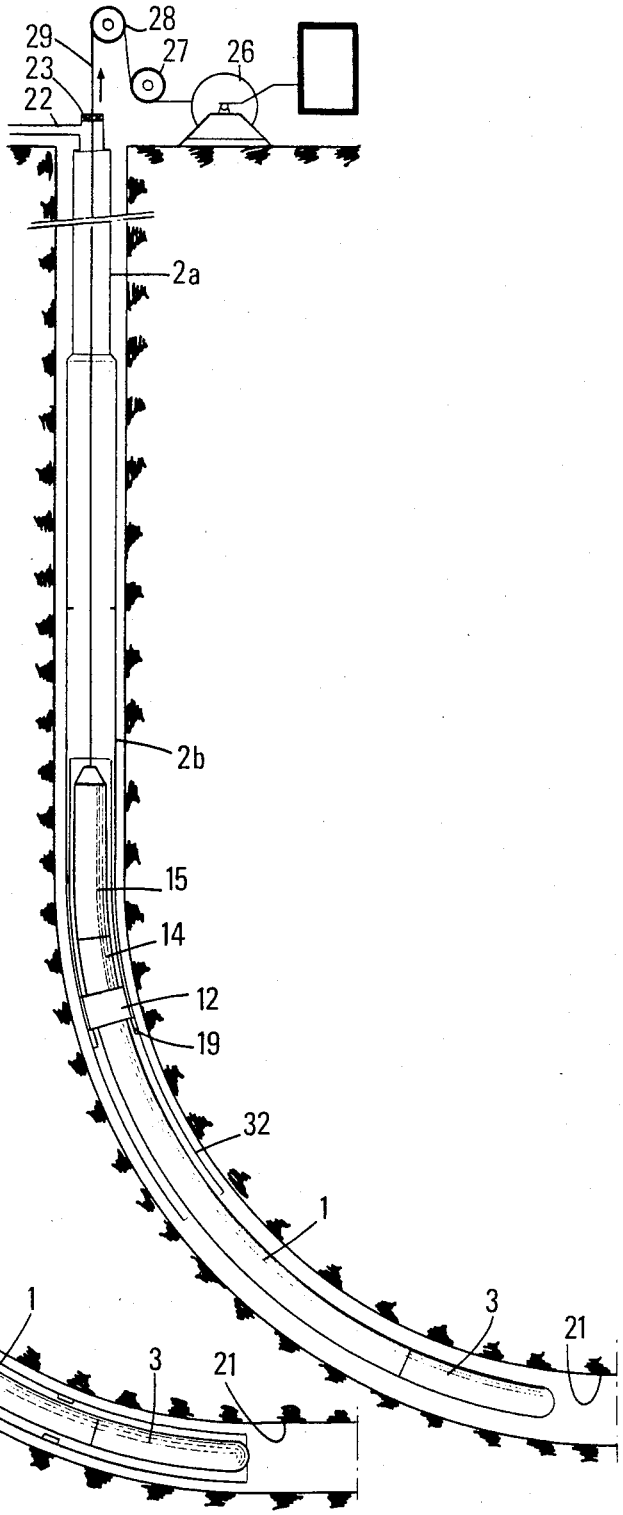

When the operation for electrically connecting the second connector portion 14 to the male plug 13 and the mechanical connection between bar 15 and base 12 have been carried out, a slight traction F exerted on cable 29 (FIG. 11) disengages, from stud 16*a*, the base 12 of the tubular element 11 which may then occupy an intermediate position such as the one shown in FIG. 2, instrument 3 being outside its protecting casing if such is provided and being then in the lower untubed, or uncovered, part of well 21 (FIG. 7).

For moving extension 1, it is possible to pump the pressurized fluid so that it exerts a force tending to move piston 18.

This embodiment is particularly appropriate in the case of greatly deflected wells.

The operations and/or measurements are then carried out by moving the probe in the uncovered portion of the well (see FIG. 7). These measurements may be carried out either by pumping the hydraulic fluid which pushes extension 1 so as to cause it to penetrate more deeply into the well, or by pulling on cable 29.

The measurements may be made when the operating means approaches the lower tube (see FIG. 7). Of course, in this latter case, the probe will have been protruded by the desired length before the measurements are undertaken.

If, after working in a first zone of the well, it is desired to work in a second zone situated at a distance from the first zone such that the length of the extension does not allow these two zones to be reached in one and the same stroke, it is then advantageous to reposition the extension in the lower tube, to raise cable 29, connector portion 14 and the loading bar 15 to the surface and to modify the length of the upper tube, either by removing elements from the string of rods, or by adding elements thereto, depending on the relative position of the two zones.

Figure 8:
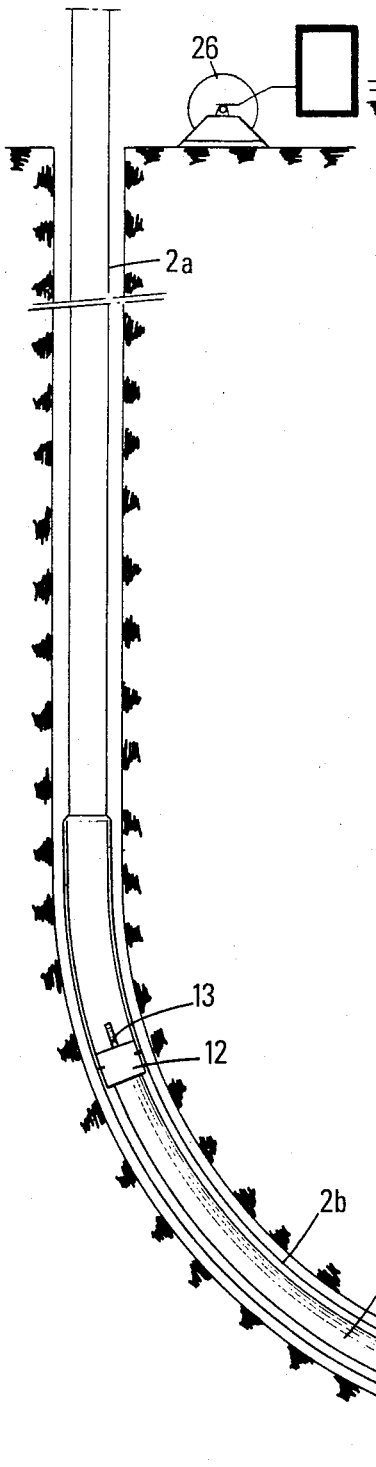

In the case of FIG. 8, the length of the upper tube has been increased.

Then, once the working zone has been reached, the cable 29 equipped with the loading bar 15 and connector portion 14 which has been coupled to connector portion 13 are introduced, the extension is caused to protrude and the operations to be undertaken are carried out.

An opening 30 may be provided in the vicinity of the lower end of the lower tube. This opening will allow a fluid to flow after the piston 18 has passed the level thereof.

Still within the scope of the present invention, passages may be provided for the flow of a fluid such as drilling sludges through the device.

Figure 12:
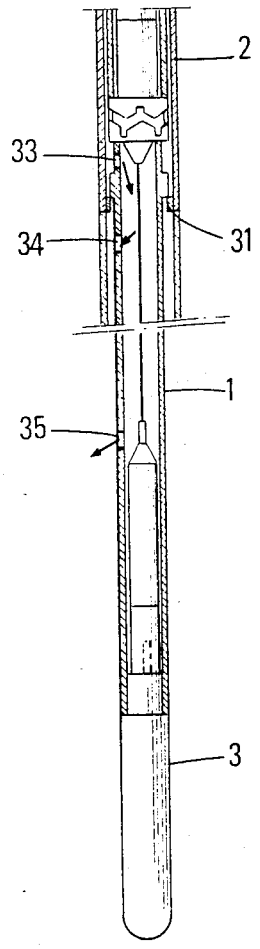
FIG. 12 shows different variants for causing a fluid to flow through the device.

Thus, when as seen in FIG. 12, the device is equipped with a constriction 31, extension 1 may be provided with a first orifice 33 placed in communication with a second orifice 34, these two orifices being disposed so that the fluid flow is established substantially once the extension is in abutment, the probe being protruded.

The first orifice 33 may be also placed in communication with a third orifice 33 situated in the vicinity of the operating instrument 3, so as to allow a fluid to flow in the low part of the well.

These arrangements of the device of the invention may also be provided if a piston 18 is used. Orifice 33 will be situated above the piston, orifice 34 below and orifice 35 in the vicinity of the probe.

Of course, the different orifices 30, 33, 34 and 35 will be dimensioned so as to maintain sufficient differential pressures so as to allow movement of extension 2 by pumping.

Figure 13:
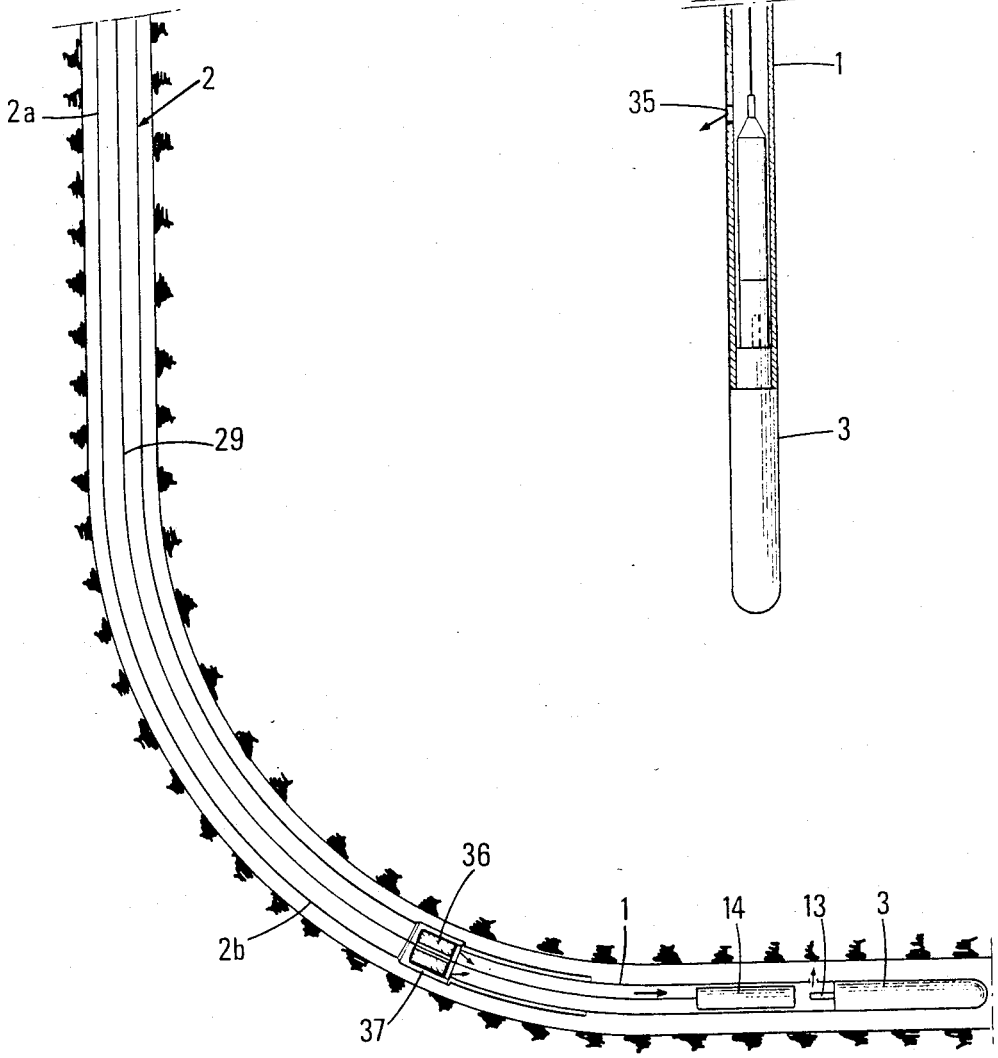
FIG. 13 illustrates the case of a device using a sliding piston.

FIG. 13 shows another embodiment in which the electrical connection is provided by a first cable 29 equipped with a connector portion 14 which penetrates into extension 2 so as to be coupled to connector portion 13 which is housed in extension 2.

In the example shown in FIG. 13, connector portion 13 is situated directly on the instrument 3.

Connector portion 14 is pumped from the surface as far as connector portion 13 and thus must be pumped through different passage sections.

So as to facilitate pumping of connection portion 14 as far as the upper end of the extension 2, a sliding piston 36 may be used which is placed about cable 29, this piston 36 bearing on connector portion 14 during pumping of this assembly in tube 2 and being retained by stops, situated for example at the upper end of the extension when connector portion 14 penetrates into extension 1.

Means, such as a recess 37 formed in the vicinity of the lower end of the lower tube **2*b***, may provide a better flow of the pumping fluid once the action of the sliding piston ceases.

Such a device may comprise means for anchoring connector portion 14 to the extension and for releasing it therefrom. These means may be situated in the vicinity of the instrument 3 and be preferably of the electro-hydraulic type remote controlled from the surface.

Finally, extension 1 may be formed of several tubular elements each comprising electrical connectors, these elements providing the electric and mechanical connection between probe 3 and the connector portion of connector 9.

What is claimed is:

1. A method for carrying out measurements and/or operations in a well, using at least one tube comprising at least two parts including an upper tubular part and a lower tubular part, an extension having an upper end and a lower end, and an instrument for carrying out measurements and/or operations fixed to the lower end of the extension, at least said upper tubular part of said tube being formed of several elements, said method comprising the steps of:

(a) fitting said extension equipped with said instrument into the lower part of said tube to form an assembly and inserting said assembly into the well;

(b) fitting the upper part of the tube above the lower part of the tube to cause increased penetration into the well by the assembly formed by the lower part of the tube, said extension and the instrument; and (c) moving the extension and the instrument with respect to the tube to a position where said instrument is able to carry out said measurements and/or operations;

in the case where said instrument is connected electrically to surface installations at the surface, said instrument being connected electrically to a first connector portion of a first electrical connector which also includes a second connector portion, these two connector portions being able to be plugged together in a liquid medium, said first connector portion being fixed with respect to said extension, said method further comprising an additional step of introducing the second connector portion in the tube as far said first connector portion to effect coupling thereof with said first connector portion, said second connector portion being fixed mechanically and electrically to a lower end of a first electric transmission cable, said cable being connected at its upper end to said surface installations, and firmly securing the second connector portions to said extension at the end of said additional step;

in the case where said instrument is connected electrically to the first connector portion of said first connector by an intermediate connection formed by a second electrical connector including a third connector portion and a fourth connector portion capable of being plugged together in a liquid medium, said third connector portion being firmly secured to said extension in the vicinity of its lower end, said method further comprising an additional intermediate step of introducing the fourth connector portion into the extension to effect coupling thereof with the third connector portion, said third connector portion being fixed mechanically and electrically to the lower end of a second electrical transmission cable, said second electrical transmission cable being connected at its upper end to said first connector portion of said first connector, and firmly securing said fourth connector portion to said extension in the vicinity of its upper end at the end of said additional intermediate step.

2. The method as claimed in claim 1, wherein at least one of said second and fourth connector portions is moved by pumping a fluid in said tube when the method is applied to deflected wells.

3. A method for carrying out measurements and/or operations in a well, using at least one tube comprising at least two parts including an upper tubular part and a lower tubular part, an extension having an upper end and a lower end, and an instrument for carrying out measurements and/or operations fixed to the lower end of the extension, at least said upper part of said tube being formed of several elements said method comprising the steps of:

(a) fitting said extension equipped with said instrument into the lower part of said tube to form an assembly and inserting said assembly into the well;

(b) fitting the upper part of the tube above the lower part of the tube to cause increased penetration into the well by the assembly formed by the lower part of the tube, said extension and the instrument; and (c) moving the extension and the instrument with respect to the tube to a position where said instrument is able to carry out said measurements and/or operations;

in the case where said instrument is connected electrically to surface insulations at the surface, said instrument being electrically connected to a first connector portion of a first electrical connector which also includes a second connector portion, these two connector portions being able to be plugged together in a liquid medium, said first connector portion being fixed with respect to said extension, said method further comprises an additional step of introducing the second connector portion of the tube as far as said first connector portion to effect coupling thereof with said first connector portion, said second connector portion being fixed mechanically and electrically to a lower end of a first electric transmission cable, said cable being connected at its upper end to said surface insulations, and firmly securing the second connector portion to said extension at the end of said additional step;

said first transmission cable penetrating into the upper tubular part through a coupling with a lateral window.

4. The method as claimed in claim 3, wherein said first connector portion is fixed directly to the instrument.

5. A method as claimed in claim 3 wherein said second connector portion is moved by pumping a fluid in said tube when the method is applied to deflected wells.

6. A device for carrying out measurements and/or operations in a well, comprising at least a tube and an extension which is tubular with a lower and and an upper end, said tube comprising at least two parts including an upper tubular part and a lower tubular part, each of said two parts as well as said extension comprising at least one element, an instrument secured to the lower end of said extension, unlockable means for anchoring said extension in the lower part of said tube, and means for moving the extension with respect to said tube; said instrument being connected electrically to a first connector portion of a first electrical connector which includes a second connector portion, said first connector portion being secured to said extension in the vicinity of its upper and, a first electrical transmission cable whose lower end is fixed mechanically and connected electrically to said second connector portion and whose upper end extends to the surface and said second connector portion including engagement means which cooperate with complementary means disposed in the vicinity of the upper end of said extension; said instrument being connected electrically to a third connector portion of a second electrical connector which also includes a fourth electrical connector portion, said third connector portion being secured to said extension in the vicinity of its lower end, a second electrical transmission cable whose lower and is fixed mechanically and connected electrically to said fourth connector portion and whose upper end is connected to said first connector portion.

7. The device as claimed in claim 6, wherein one at least of said second and fourth connector portions comprises means for moving same by pumping.

8. The device as claimed in claim 6, wherein one at least of said second and fourth connector portions comprises an unlockable anchorage member.

9. The device as claimed in claim 6, wherein the upper tubular part comprises a coupling with a lateral window for allowing said first cable to pass therethrough.

10. The device as claimed in claim 9, wherein said second connector portion comprises an unlockable anchorage member.

11. A device for carrying out measurements and/or operations in a well, comprising at least a tube and an extension which is tubular with a lower end and an upper end, said tube comprising at least two parts including an upper tubular part and a lower tubular part, each of said two parts as well as said extension comprising at least one element, an instrument secured to the lower end of said extension, unlockable means for anchoring said extension on the lower part of said tube, and means for moving the extension with respect to said tube; said instrument being connected electrically to a first connector portion of a first electrical connector which includes a second connector portion, said first connector portion being secured to said extension in the vicinity of its upper end, a first electrical transmission cable whose lower end is fixed mechanically and connected electrically to said second connector portion and whose upper end extends to the surface and said second connector portion including engagement means which cooperate with complementary means disposed in the vicinity of the upper end of said extension; the upper tubular part comprising a coupling with a lateral window for allowing said first cable to pass therethrough.

* * * * *